US008069530B2

(12) United States Patent
Alton

(10) Patent No.: US 8,069,530 B2
(45) Date of Patent: Dec. 6, 2011

(54) TRIPLE-BEARING BRISTLED ROLLER WITH COMPREHENSIVE THREAD GUARD SYSTEM

(76) Inventor: James R. Alton, Bellingham, WA (US)

( * ) Notice: Subject to any disclaimer, the term of this patent is extended or adjusted under 35 U.S.C. 154(b) by 1016 days.

(21) Appl. No.: 12/002,847

(22) Filed: Dec. 18, 2007

(65) Prior Publication Data

US 2008/0244852 A1 Oct. 9, 2008

Related U.S. Application Data

(60) Provisional application No. 60/875,708, filed on Dec. 18, 2006.

(51) Int. Cl.
*A47L 5/30* (2006.01)

(52) U.S. Cl. ..... 15/392; 15/389

(58) Field of Classification Search ..... 15/389, 15/392; *A47L 5/30, 9/04*

See application file for complete search history.

(56) References Cited

U.S. PATENT DOCUMENTS

| | | | | |
|---|---|---|---|---|
| 3,737,937 | A | 6/1973 | Nordeen | |
| 4,403,372 | A | 9/1983 | Keane et al. | |
| 4,429,430 | A | 2/1984 | Lyman | |
| 4,847,944 | A | 7/1989 | Lackner | |
| 4,976,003 | A * | 12/1990 | Williams | 15/372 |
| 5,249,328 | A | 10/1993 | Shin | |
| 5,435,038 | A | 7/1995 | Sauers | |
| 5,598,600 | A | 2/1997 | Stegens | |
| 6,539,575 | B1 | 4/2003 | Cohen | |
| D478,698 | S | 8/2003 | Mertes et al. | |

* cited by examiner

*Primary Examiner* — David Redding
(74) *Attorney, Agent, or Firm* — Todd N. Hathaway

(57) ABSTRACT

A spinning bristled roller assembly for the nozzle of a vacuum cleaner or other carpet cleaning apparatus. The roller assembly includes three bearings protected by a comprehensive thread guard system. The three bearing system, in combination with the structure of the tubular roller body and bearing housing provides an assembly having inherently improved balance characteristics that eliminate the prior need for dynamic balancing to ensure vibration-free operation.

32 Claims, 6 Drawing Sheets

28a
30a
76
74
42a
21a
39a
24a
61a
38
20
70
72
62a
58
56
42a
54a
58b
30b
39b
24b
24c
21b
47a
45
47c
47b
30c
42b
64
66
67
62b
61b
68
69
28b
54b

TRIPLE-BEARING BRISTLED ROLLER WITH COMPREHENSIVE THREAD GUARD SYSTEM

RELATED APPLICATIONS

This application claims the benefit of U.S. Provisional Patent Application Ser. No. 60/875,708 filed on 18 Dec. 2006.

BACKGROUND a. Field of the Invention

This invention relates generally to vacuum cleaners and similar apparatus for cleaning carpets and other floor surfaces, and more particularly, to a bristled roller assembly for the nozzles of such apparatus that provides reduced vibration, simplified manufacture and extended product life.

b. Related Art

For the purpose of cleaning carpets and extending carpet life, the nozzles of vacuum cleaners and other carpet cleaning apparatus commonly feature spinning bristled rollers. Typically, the bristled roller assemblies are made up of the following components: a long core axle; one or two bearings or sleeve bushings which may be installed at or near opposite ends of the axle; a geared or smooth-surfaced pulley, which may be positioned at either end of the assembly or at any point in between; a belt, which may be geared or smooth, and flat, round or v-shaped depending on the pulley type; a one-piece solid or hollow bristled roller body of plastic, wood or other material; one or more thread guard elements to reduce the accumulation of hair and other fibers which would otherwise enter and jam the bearings and/or other components of the roller assembly; and an endcap at or near each end, that support the assembly for spinning rotation relative to the fixed structure of the nozzle.

The roller assemblies may be powered by electric motors, or by air-driven impellers propelled by the airflow generated by the carpet cleaning apparatus. The shaft extensions of the motors or impellers may be smooth or may feature a geared or otherwise shaped pulley for engaging one end of a belt, the other end of which is in engagement with the nozzle's bristled roller assembly.

The above-described components are typically assembled in a generally linear arrangement, and since mass-produced components are typically less than perfect dimensionally, the linear arrangements commonly result in an imbalance of the bristled roller assembly; when the roller is spinning rapidly, this imbalance tends to generate excessive vibration, which not only renders operation unpleasant, but also may lessen the life of the roller assembly and/or the other components of the nozzle assembly such as the motor. Consequently, not unlike the need to dynamically balance newly-installed tires on automotive wheels, the roller assemblies must typically be balanced dynamically, through an expensive and arguably inconsistent worker-dependent procedure, whereby small counterweights are installed in the roller in an attempt to improve balance and lessen vibration. Typically, a bristled roller assembly is considered sufficiently balanced and its vibration acceptable for product warranty if the difference in weight between an assembly's opposite ends (the spinning weight differential) is less than one gram.

Accordingly, there exists a need for an improved roller brush assembly that incorporates the features necessary for its operation but with enhanced stability and balance characteristics that reduce or eliminate the need for a separate balancing step during manufacture. Furthermore, there exists a need for such a roller brush assembly that can be manufactured quickly and economically, and that is durable, long-lasting and generally maintenance-free during use.

SUMMARY OF THE INVENTION

The invention utilizes a stabilizing third bearing to produce an easy to manufacture, virtually vibration-free roller brush assembly having an inherently consistent end-to-end spinning weight differential, thereby eliminating the need for dynamic balancing. Furthermore, the invention features a comprehensive thread-guard system to prevent hair and other fibers from entering and jamming the bearings and/or affecting other spinning components of the bristled roller assembly.

In a broad aspect, the present invention provides a roller brush assembly for a vacuum nozzle, the roller brush assembly comprising: (a) a generally tubular roller body having drive and non-drive ends and at least one brush feature on an outer surface thereof, (b) an elongate axle member disposed annularly within the roller body, (c) a drive pulley mounted to the drive end of the roller body, and (d) a plurality of bearings supporting the roller body for rotation about the axle, the plurality of bearings comprising: a first bearing mounted proximate the drive end of the roller body, a second bearing mounted proximate the non-drive end of the roller body, and a third bearing mounted in the drive pulley at a location at the drive end of the roller body that is distal of the first bearing.

The third bearing may be located substantially adjacent the first bearing at the drive end of the roller body.

The assembly may further comprise first and second bearing housings having of the first and second bearings mounted therein, each bearing housing comprising an interior receptacle that maintains the bearing therein in transverse alignment with the axle, and an exterior surface that engages the roller body so as to maintain the bearing therein in a predetermined longitudinal position along the axle.

The exterior surface of each bearing housing may comprise at least one stop portion that engages a cooperating stop portion on the tubular roller body so as to limit insertion of the bearing housings and first and second bearings to predetermined locations in the drive and non-drive ends of the roller body. The at least one stop portion of the exterior surfaces of the bearing housings may comprise an external shoulder that cooperates with an internal shoulder of the tubular roller body to limit insertion of the bearing housing to a predetermined position within the roller body.

The drive pulley may comprise an interior receptacle that maintains the third bearing therein in transverse alignment with the axle, and an exterior surface that engages the roller body so as to maintain the third bearing in a predetermined longitudinal position on the axle. The exterior surface of the pulley may comprise at least one stop portion that engages a cooperating stop portion of the two bearing roller body so as to limit insertion of the pulley and third bearing to a predetermined location in the drive end of the roller body. The at least one stop portion on the exterior surface of the pulley may comprise an external shoulder of the pulley that cooperates with shoulder on the tubular roller body to limit insertion of the pulley and third bearing. The predetermined position of the pulley and third bearing may be substantially adjacent the location of the first bearing and bearing housing in the drive end of the roller body.

The exterior surface of the pulley may further comprise means for establishing rotational drive engagement between the pulley and the roller body. The means for establishing rotation drive engagement between the pulley and the roller body may comprise a plurality of ribs on the pulley that are received in cooperating slots in the tubular body. The pulley may further comprise a toothed drive pulley for engaging a toothed drive belt.

The elongate axle may further comprise a raised shoulder proximate the drive end of the roller body, that reacts against an inner race of the third bearing so as to maintain the third bearing and pulley in the predetermined location in the drive end of the roller body.

The drive pulley may be molded over the third bearing so as to precisely locate the third bearing therein, and the first and second bearing housings may likewise be molded over the first and second bearings.

The roller brush assembly may further comprise first and second thread guards located proximate the drive and non-drive ends of the roller body. The thread guards may each comprise first and second longitudinally spaced annular ridges, and a stepped annular trough intermediate ridges, the annular trough comprising a first, relatively deeper trough portion and a second relatively shallower trough portion located distal at the first trough portion. Each of the thread guards may further comprise a third trough formed on a proximal side of the spaced annular ridges.

The roller brush assembly may further comprise first and second end cap members mounted to ends of the elongate axle for attachment of the roller brush assembly to a fixed structure of a vacuum nozzle.

The present invention also provides a vacuum nozzle, comprising: (a) a nozzle housing, and (b) a roller brush assembly mounted to the nozzle housing, the roller brush assembly comprising: (i) a generally tubular roller body having drive and non-drive ends and at least one brush feature on an outer surface thereof, (ii) an elongate axle member disposed annularly within the roller body, (iii) a drive pulley mounted to the drive end of the roller body, and (iv) a plurality of bearings supporting the roller body for rotation about the axle, the plurality of bearings comprising: a first bearing mounted proximate the drive end of the roller body, a second bearing mounted proximate the non-drive end of the roller body, and a third bearing mounted in the drive pulley at a location at the drive end of the roller body that is distal of the first bearing.

These and other features and advantages of the present invention will be more fully appreciated from a reading of the following detailed description with reference to the accompanying drawings.

DETAILED DESCRIPTION OF THE INVENTION

Figures 1, 2, 3:
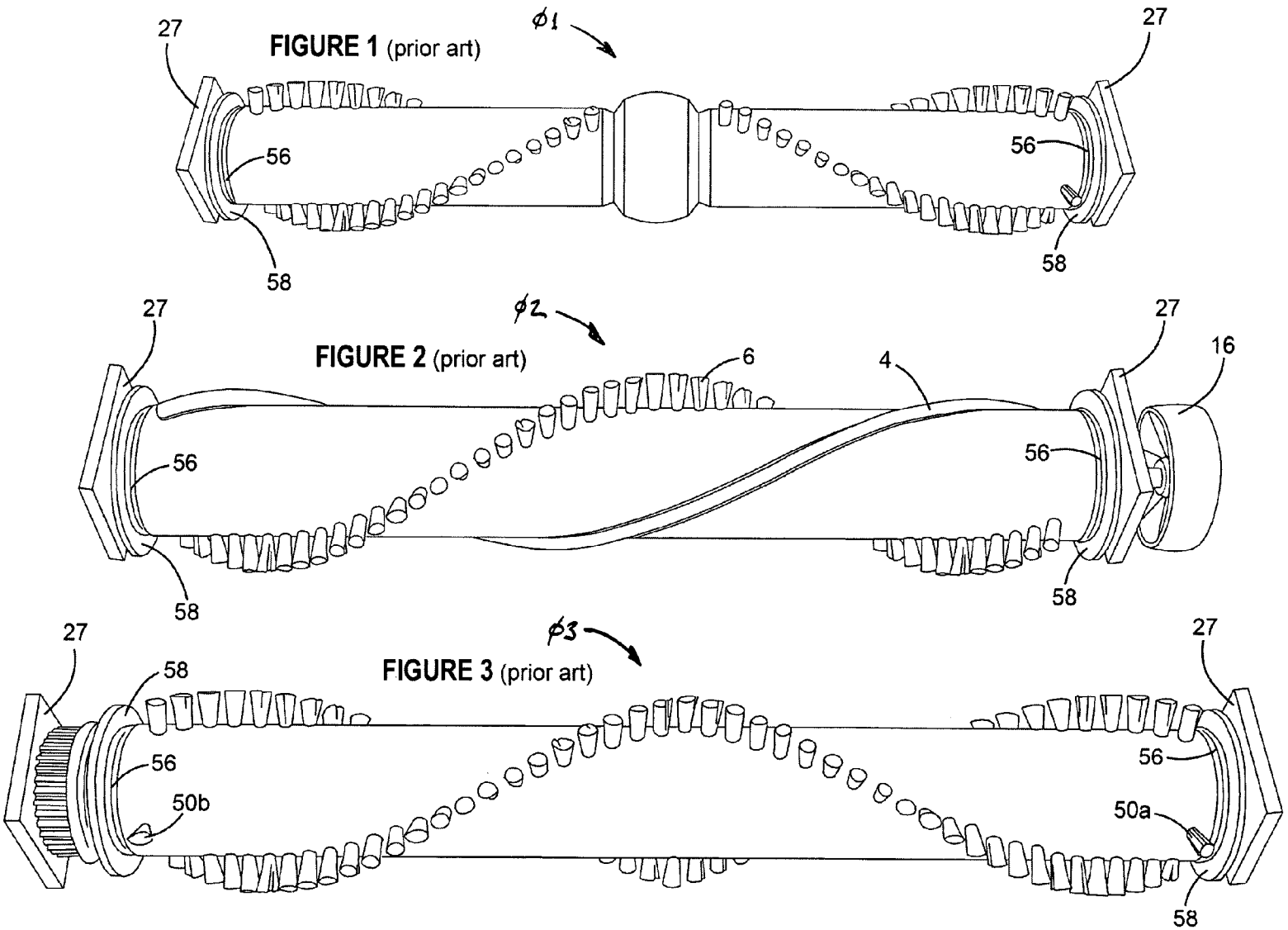
FIGURE 1 (prior art)
FIGURE 2 (prior art)
FIGURE 3 (prior art)
FIG. 1 is a perspective view of a prior art roller assembly having a built-in flat-belt pulley centered on a roller having two chevron-shaped rows of bristles.
FIG. 2 is a perspective view of a prior art roller assembly having a flat-belt pulley at one end and having one spiraling row of bristles and one spiraling "beater bar;"
FIG. 3 is a perspective view of a prior art roller assembly having a geared pulley at one end and two chevron-shaped rows of bristles, all between two endcaps.
Figure 4:
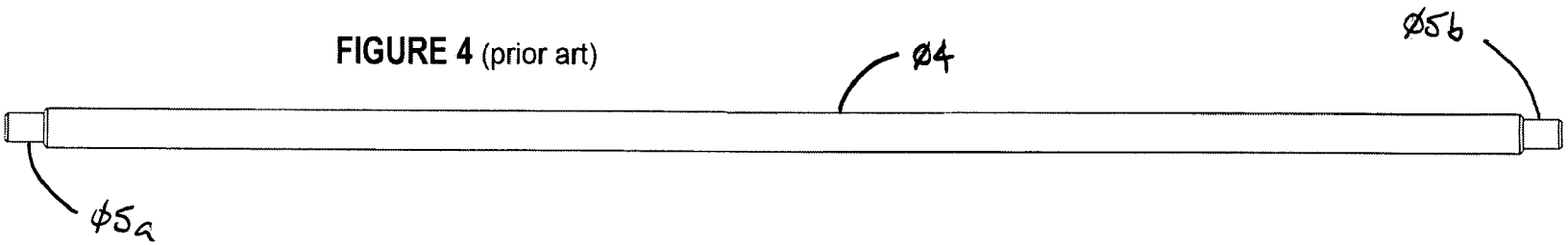
FIGURE 4 (prior art)
FIG. 4 is an elevational view of a prior art full-length steel axle which is typical of the prior art roller assemblies of FIGS. 1-3.
Figure 5:
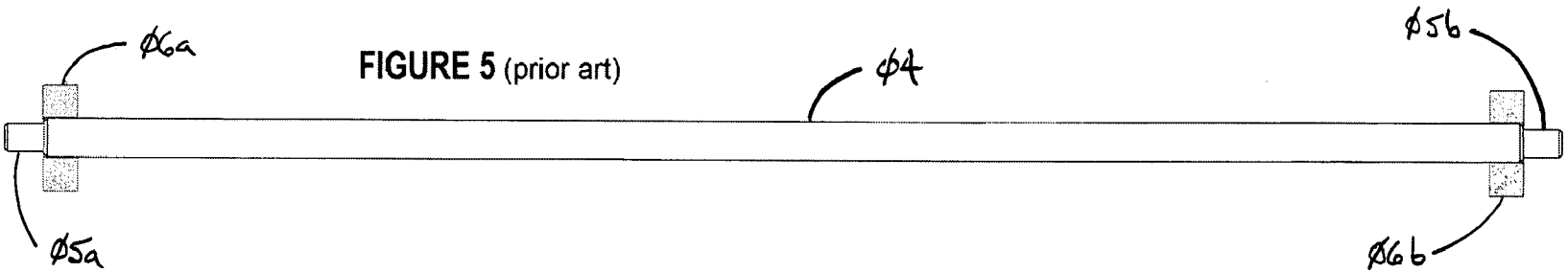
FIGURE 5 (prior art)
FIG. 5 is an elevational view, partly in cross-section, of the prior art axle of FIG. 4 with a typical installation of bearings near each end of the axle.
Figure 6:
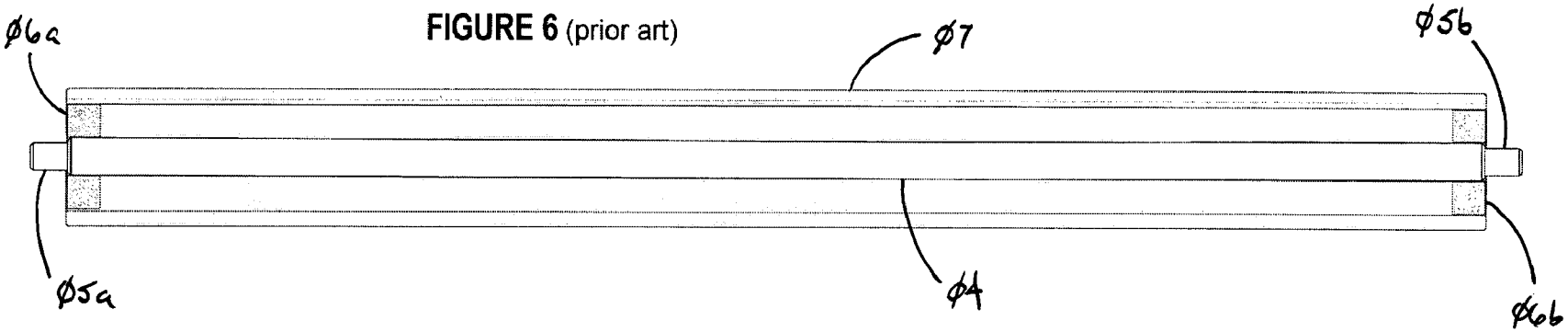
FIGURE 6 (prior art)
FIG. 6 is simplified cross-sectional view of a typical prior art roller assembly having the full-length axle and bearings of FIGS. 4-5 installed therein.

FIGS. 1-3 show a series of exemplary prior art roller brushes of slightly different types, namely a center pulley roller brush assembly (01) having two chevron-shaped rows of bristles, a flat-belt end pulley assembly (02) having a spiral row of bristles and a spiral beater bar, and a toothed-belt end pulley assembly (03) having chevron-shaped rows of bristles. As is described above, and as is shown in FIGS. 4-6, the prior art roller assemblies typically include a lengthwise axle (04), frequently, stepped at the ends to have reduced diameter portions (05*a*), (05*b*) that fit with the supporting end caps (not shown in FIGS. 4-6). Bearings (06*a*), (06*b*) are installed on the ends of the axle (04), typically with the inner races of the bearings being pressed onto the main diameter of the axle. The tubular roller body (07) is supported on the bearings (06*a*), (06*b*), typically with an inner wall of the roller body being in press-fit engagement with the outer races of the bearings. The roller body is therefore able to spin on the bearings (06*a*), (06*b*) while the axle (04) remains stationary, supported in the end caps that are mounted to the fixed structure of the nozzle housing.

As was discussed above, the construction that is shown in FIGS. 4-6, which is typical of prior art roller brush assemblies, is prone to misalignments and imbalances that produce unacceptable vibration in use. As was also discussed, weight and imbalances in the assemblies can be corrected to a certain extent, but at the expense of a labor-intensive and comparatively costly dynamic balancing process. However, vibration due to misalignment between components, which is virtually unavoidable with the prior art design, is for practical purposes essentially impossible to eradicate; for example, it will be seen in FIGS. 4-6 that the prior art design includes no means for positively positioning the bearings at precise locations along the length of the shaft or relative to the length of the tubular roller body, nor is there any means of ensuring precise alignment between the axis of the shaft and the transverse plane of the bearings. Thus, even with careful assembly, the locations of the bearings along the shaft and within the roller housing tends to vary, and the bearings very frequently end up being slightly "cocked" within the assembly. Although the resulting misalignment tends to be slight, it nevertheless results in significant vibration during use, given the high speed of rotation at which the roller brush assembly operates; moreover, since these deficiencies are an inherent aspect of the typical prior art design, the vibration is essentially impossible to eradicate.

Figure 7:
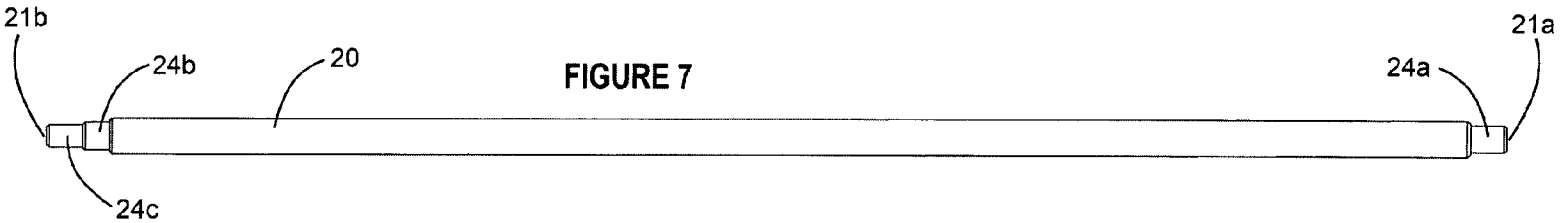
FIG. 7 is an elevational view of the stepped full-length steel axle of a roller brush assembly in accordance with a preferred embodiment of the present invention.
Figure 8:
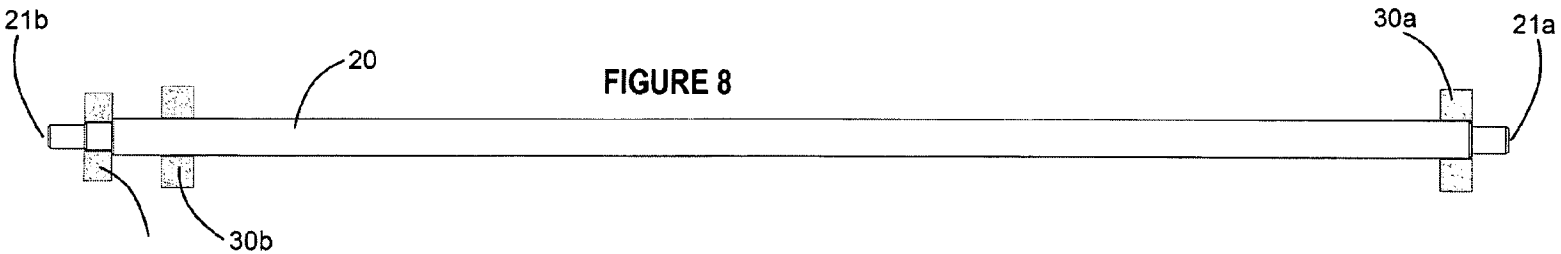
FIG. 8 is an elevational view, partly in cross-section, showing three bearings installed on the axle of FIG. 7.
Figure 15:
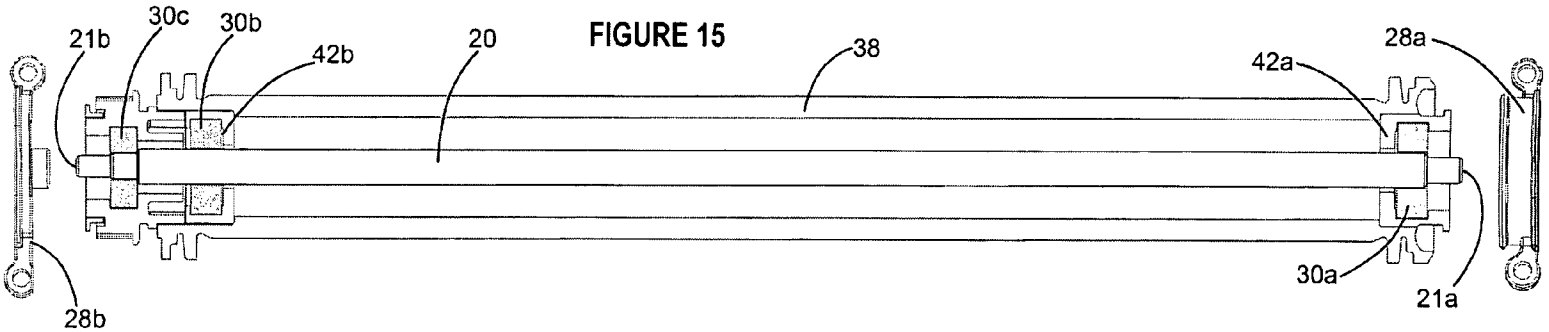
FIG. 15 is a cross-sectional, exploded view of the roller assembly, of FIGS. 13-14, showing two endcaps that are pressed onto the two ends of the axle.
Figure 16:
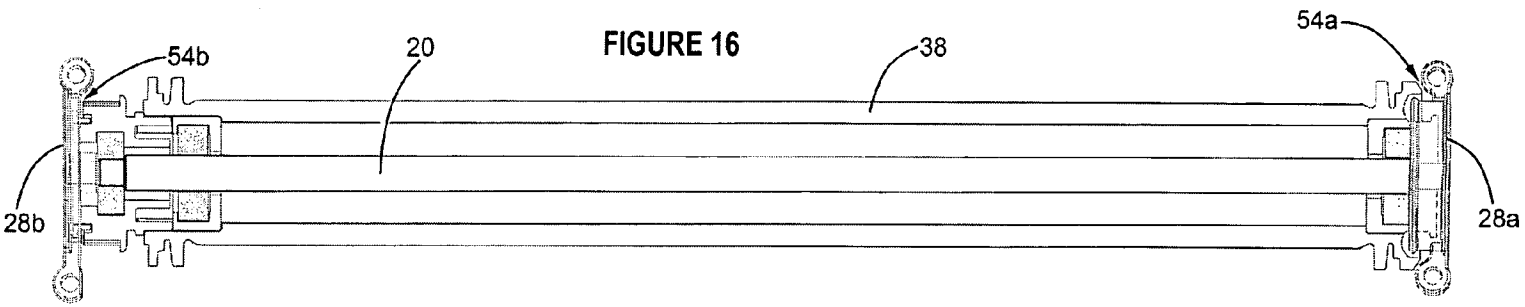
FIG. 16 is a cross-sectional view of the roller assembly, of FIGS. 13-15, showing the endcaps installed and the assembly completed.
Figure 17:
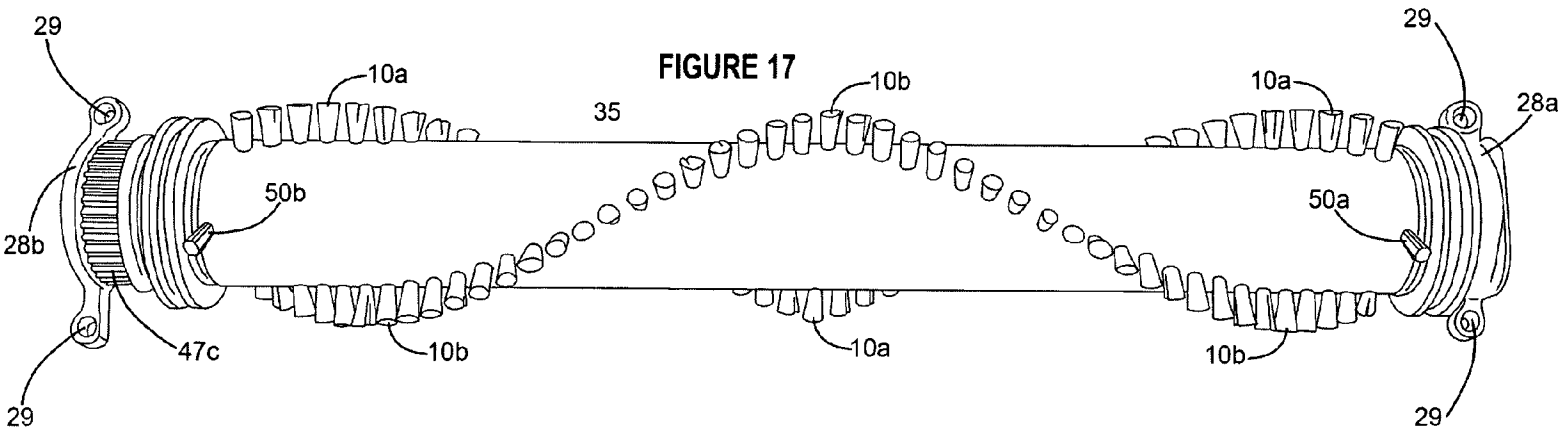
FIG. 17 is a perspective view of the completed roller assembly of FIG. 16, showing the external configuration of the components thereof in greater detail.

FIG. 7, in turn, shows a preferred embodiment of the present invention which includes a full-length axle (20), and endcaps (28*a*, 28*b*) at or near the left and right ends of the axle, as also seen in FIGS. 15-17. The endcaps are preferably press-fit onto splined ends of the axle in order to achieve precise alignment, however, in some embodiments one or both of the endcaps (28*a*, 28*b*) may rotate snuggly around the axle, depending on whether rotational adjustment to the alignment of two endcaps is desired for precise fitting inside certain specially-configured nozzles of carpet cleaning apparatus. The axle (20) may be stepped (24*a*, 24*b*, 24*c*) as seen in FIG. 7, to allow linear positioning of the assembly's bearings (30*a*, 30*b*, 30*c*) as seen in FIG. 8, and/or other components of the bristled roller assembly (35) as seen in FIG. 17. Further, one or both of the endcaps (28*a*, 28*b*) may be designed to slide or otherwise fit into slots inside special nozzles of a vacuum cleaner or other carpet cleaning apparatus (see element 27 in FIGS. 1-3), or may include screw holes (see element in FIG. 17) for secure mounting inside the nozzle housings.

Figure 9:
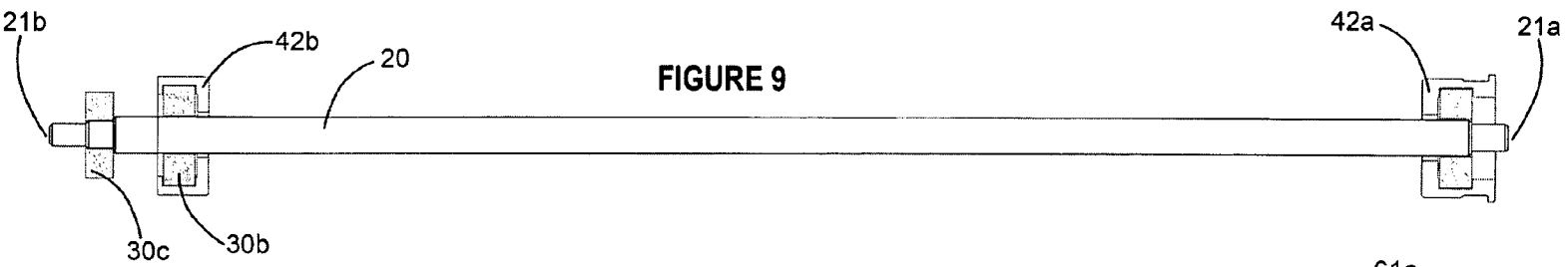
FIG. 9 is an elevational view, similar to FIG. 8, showing the first two bearings of FIG. 8 installed on the axle in their respective bearing housings.

The first of the preferred embodiment's three bearings (30*a*) may be pressed into its position on the axle (20) at or near the axle's right end (21*a*) as seen in FIG. 9. For ease of description, the assembly's pulley-end (drive end) will be referred to herein as the assembly's "left end," and the assembly's other end (non-drive end) will be referred to as its "right end," although it will be understood that the orientation may be reversed in the actual installation, depending on design factors. This first bearing's inside diameter approximately matches the axle's outside diameter or a stepped, reduced diameter so the bearing fits snuggly on the embodiment's axle, and the outside diameter of the first bearing (30*a*) may approximately match the inside diameter of the roller tube (38). However, this first bearing is preferably installed inside a bearing housing (42*a*) as seen assembled together in FIG. 13. The bearing housing may have two or more raised ribs (33*a*) and whose outside diameter may approximately match the inside diameter of one or both of the roller's ends (39*a*, 39*b*), and the roller end(s) may be have slots (43) to accommodate the ribs of the bearing housings (42*a*, 42*b*); it will be understood that splines and for other interlocking features may be used in place of or in conjunction with the ribs and slots that are shown. The bearings may be of any suitable type, such as ball or roller bearings.

Figure 12:
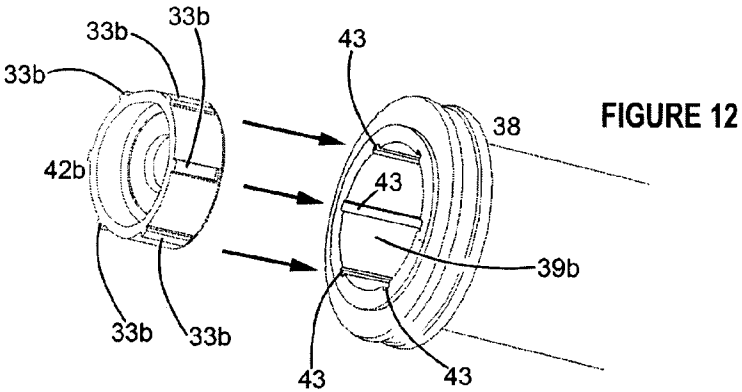
FIG. 12 is a perspective, exploded view of the drive end of the roller body and the second bearing housing that fits into the end of the roller body inboard of the drive pulley and bearing of FIG. 11.
Figure 11:
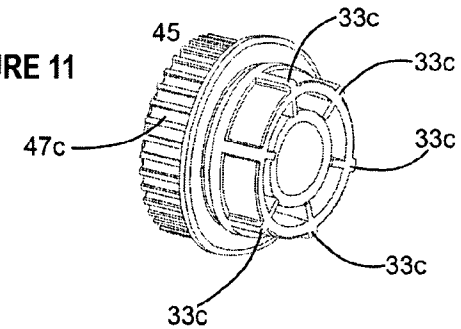
FIG. 11 is a perspective view of a geared drive pulley that mounts in an end of the tubular roller body and that houses the associated bearing therein.
Figure 13:
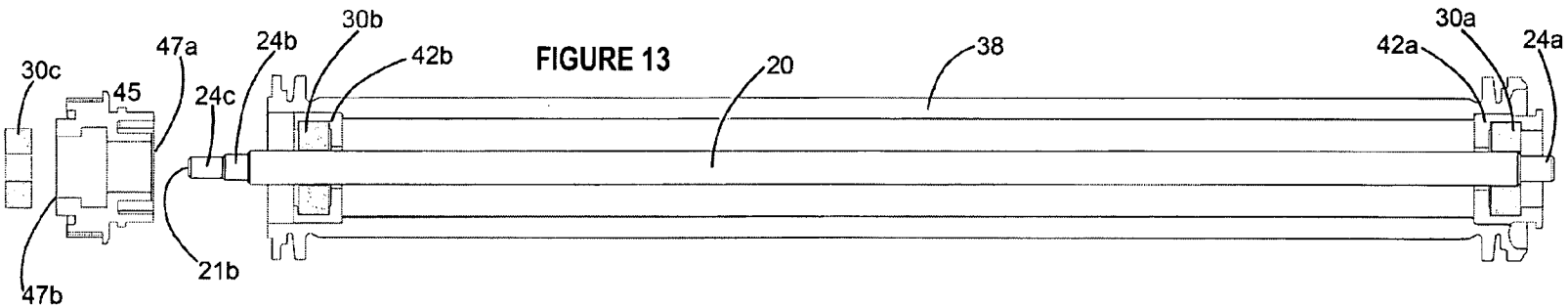
FIG. 13 is a cross-sectional, exploded view of the roller assembly of the preferred embodiment, showing the roller body installed on the first two bearings, and also the pulley and third bearing that are to be pressed into the roller body on the stepped end of the axle.
Figure 14:
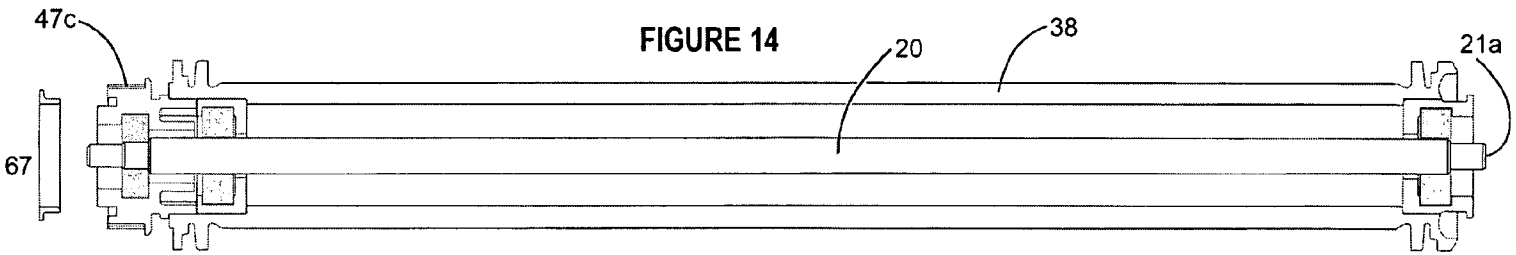
FIG. 14 is a cross-sectional, exploded view of the roller assembly, of FIG. 13, showing the roller body, pulley, and bearings installed on the axle, together with a thread guard that is pressed into the outboard end of the pulley.

A second bearing (30*b*), which may have the same or different inside and/or outside diameters as the first bearing (30*a*), may be installed on the axle (20) by pressing or sliding the second bearing (30*b*) inward from the axle's opposite/right end (21*b*) as seen in FIGS. 8 and 9. However, as with the first bearing, second bearing is preferably installed inside a bearing housing (42*b*), which again may have ribs (33*b*) as seen in FIG. 12 or other interlocking features. Referring to FIG. 13, the roller (38), which may be shorter than the axle (20) for the purpose of accommodating additional components, may be assembled together with these first two bearings (30*a*, 30*b*) or bearing housings (42*a*, 42*b*). While the first bearing-and-housing (30*a*, 42*a*) may be pressed onto one end of the roller body (38) so as to be approximately flush with that end of the roller (39*a*) as seen in FIGS. 13 and 14, the second bearing-and-housing (30*b*+42*b*) may be pressed more deeply into the roller body's left end (39*b*) as seen in FIG. 13 and in close-up FIG. 18, so as to be recessed to allow the ribs (33*c*) of the present embodiment's geared pulley (45) to fit inside the roller's left/pulley-end (39*b*) as seen in FIGS. 11 and 12.

Linearly, the inward end (47*a*) of the present embodiment's geared pulley (45) may be shaped and slotted to fit inside the roller body's left/pulley-end (39*b*), against or near the previously installed second bearing's housing (42*b*). The pulley's opposite end (47*b*) may be geared (47*c*) as seen in FIG. 11, to accommodate a geared belt. Alternately, the pulley may be shaped or surfaced to accommodate different types and forms of belts, such as smooth (16) to accommodate a flat belt (as seen in FIG. 2), or may have a v-shaped groove to accommodate a v-shaped belt (not shown), or a round groove to accommodate a round belt (not shown), and so forth. Further, the pulley's geared end (47*b*) is preferably to house the present embodiment's stabilizing third bearing (30*c*), as seen as separate components in FIG. 13 and assembled together in FIG. 14 (also see close-up FIGS. 18 and 19). It will be understood that the third bearing may have different diameters than the first or second bearings (30*a*, 30*b*).

It can be seen in FIGS. 13-16 that shoulders formed on the bearing housings, pulley and tubular roller body cooperate to precisely position the bearings longitudinally relative to the body and shaft, thus preventing inadvertent mispositioning. Furthermore, the interior and exterior surfaces of the housings and pulley maintain precise transverse alignment between the bearings and the shaft, preventing the bearings from becoming misaligned or "cocked" during installation or use. For optimal precision and stability the outboard bearing on the drive end may be molded within the pulley (e.g., using an over-molding process), and the other bearings may likewise be molded within their respective housings.

The roller assembly of the present invention, having the construction described above, exhibits significantly improved balance characteristics as compared with typical prior art assemblies, to the point that the need for dynamic balancing is essentially eliminated. The three bearings maintain a precise alignment of the roller body and drive pulley along the axle, because the bearings (by comparison with ordinary plastic or wood pieces) are by their nature precisely sized, dimensionally stable components. The engagement between the pulley and the bearing housings with the tubular roller body then acts in conjunction with the bearings to ensure stable, very precise alignment of these pieces. Furthermore, the reduced wall thickness of the plastic components, owing to the diameter of the bearings, reduces the amount of rotating material that is subject to flaws/inconsistencies stemming from the molding or other shaping process. In prior designs, the drive pulley represents the largest mass or "lump" of plastic and consequently is a principle source of imbalances; locating the bearing inside the pulley not only reduces the mass of the molded component, minimizing the effect of flaws, but also (as noted above) centers it accurately on the axle.

To protect the assembly's bearings from various strands, hairs and other fibers, henceforth referred to collectively as "threads," and to thus maintain the assembly's ability to operate at the high RPMs required for acceptable cleaning performance, the present embodiment features a comprehensive thread guard system, as shown in the attached drawings and described below.

Referring to FIG. 16, it will first be understood that during the process of the spinning assembly's collection of threads (which is an unavoidable aspect of carpet cleaning), those threads that accumulate near the assembly's left and right ends are attracted to the two narrow but necessarily open channels (54*a*, 54*b*), that lay between the assembly's two stationary endcaps (28*a*, 28*b*) and the spinning assembly that includes all of the assembly's other components (except the stationary axle (20)). The source of this attraction is the considerable vacuum/suction created between the assembly's spinning components and stationary endcaps in a phenomenon not unlike the vacuum/suction created in the narrow space between two trains when rushing past each other in opposite directions.

The following is a detailed description of the assembly's unprecedented sixteen thread guard elements that serve to virtually seal the present embodiment's otherwise vulnerable bearings. As will be described, certain of these elements (as specifically identified) are known individually in the prior art while others are novel with the present invention; furthermore, the sequence of the elements and the manner in which they cooperate is also believed to be novel and non-obvious over the prior art.

Element #1 which is known in the prior art is the roller's two evenly spaced chevron-shaped rows of bristles, as seen in FIGS. 1-3, and 17. It has long been established that two spinning rows of bristles (as seen in prior art FIGS. 1 and 3) more effectively collect threads than the combination of one row of bristles and a non-bristled "beater bar" (4) as seen in FIG. 2. Further, and most importantly with regard to the movement of collected threads toward the bristled roller's opposite ends, by configuring the bristle clumps in chevron-shaped rows (also prior art), the chevron shape serves to move collected threads inward from the left and right to the roller's center and away from the roller's vulnerable bearing-containing ends, rather than spiraling the collected threads toward the ends of the roller as is typical of spiral-shaped bristle rows (6) seen in FIG. 2.

Element #2 also known in the prior art is a stand-alone clump of bristles (50*a*, 50*b*) as seen in FIG. 17, located laterally near each end of the roller (38) and rotationally halfway between the roller's two evenly spaced chevron-shaped rows of bristles (10*a*, 10*b*). This second thread guard element is designed to serve as a barrier against threads spinning atop the two bristle rows, but which typically lay flat halfway in between the two bristle rows where many of the threads are blocked from moving further outward toward the ends of the assembly by this relatively tall device.

Element #3, again prior art, is a single trough (56) as seen in FIGS. 1-3. The trough may be 2-3 mm wide and 2-3 mm deep and may encircle the roller and may be located just past the second thread guard element near each end of the roller. This third thread guard element is intended: a) to collect those threads that manage to jump the second thread guard element; and, b) to make it more difficult for the threads to jump element #4.

Element #4 is a thin raised ring (58) as seen in prior art FIGS. 1-3. The ring attached to or molded onto the roller for the purpose of creating a high barrier between wayward threads and the assembly's open channels (54*a*, 54*b*) as seen in FIG. 16. Single raised rings are known in the prior art, but not in conjunction with additional troughs and rings as described below.

Figure 10:
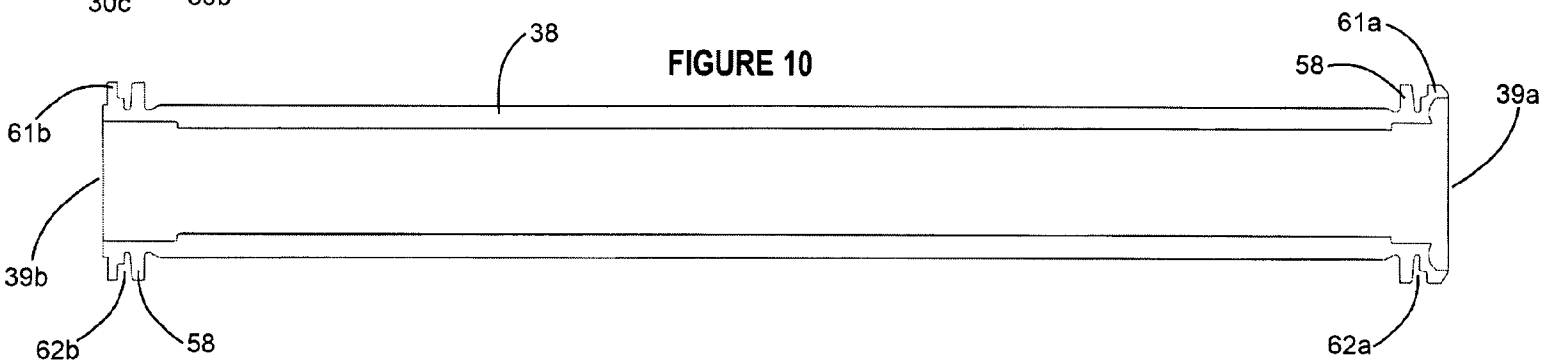
FIG. 10 is a cross-sectional view of the roller body shell of the assembly of the preferred embodiment, into which the axle and bearings of FIGS. 7-9 are installed.

Elements #5 and #6, which are part of the presentation invention, comprise a second similarly-shaped raised annular ridge or ring (61*a*, 61*b*) as seen in FIG. 10, which is of similar height and is stepped and which is separated from the first raised ring (58) by a second trough (62*a*, 62*b*), which may be approximately as deep as the first trough (element #2 above). The second trough is therefore stepped, being shallower on its distal (outboard) side and deeper on its proximal (inboard) side. This combination serves to more than double the effectiveness of the guard relative to the prior art single ring.

Figures 18, 19, 20, 21, 22, 23, 24:
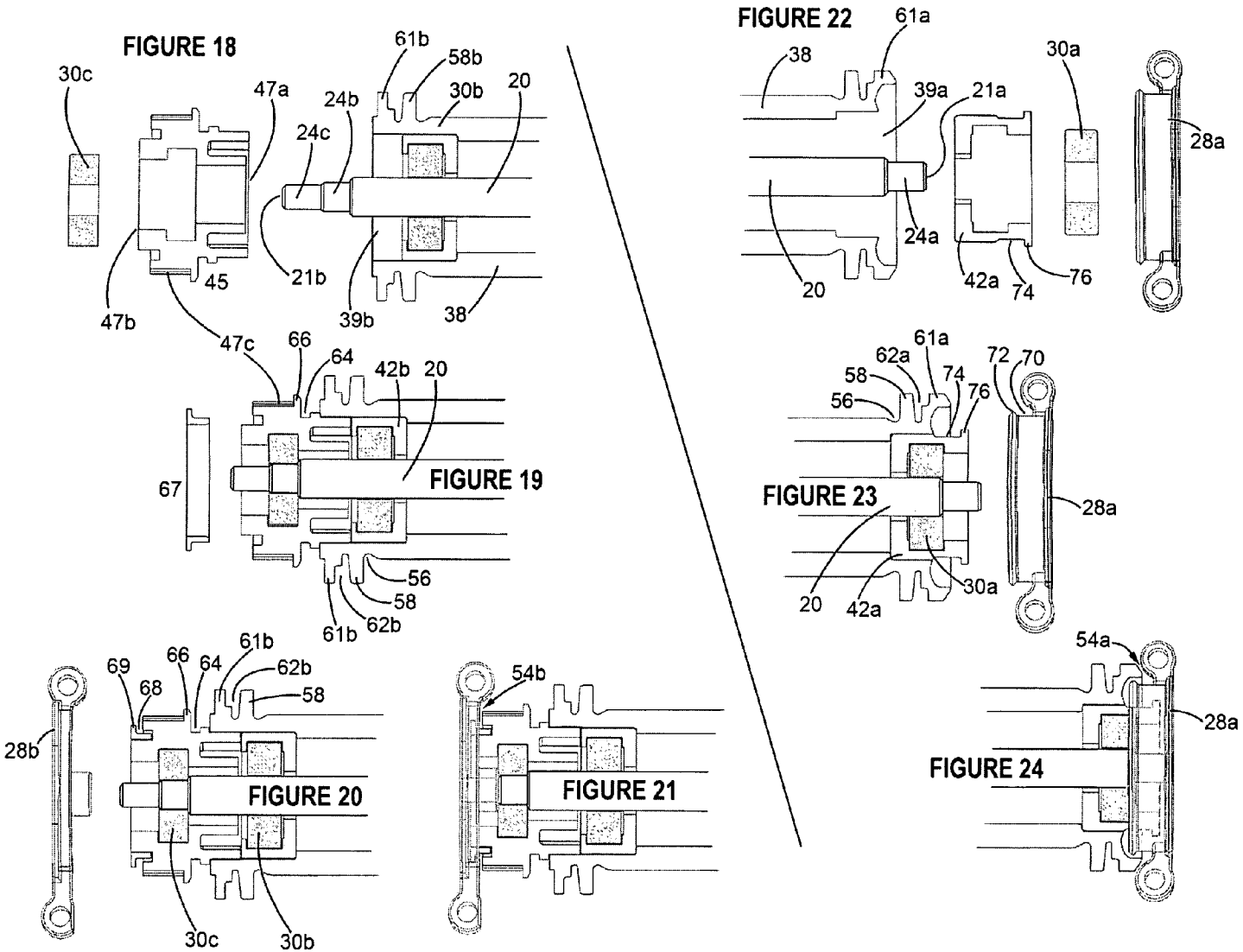
FIG. 18 is an enlarged cross-sectional, exploded view of the drive end of the roller assembly of FIGS. 13-16.
FIG. 19 is an enlarged cross-sectional, partially assembled view of the drive end of the roller assembly of FIGS. 13-16.
FIG. 20 is an enlarged cross-sectional, partially assembled view of the drive end of the roller assembly of FIGS. 13-16 prior to installation of the endcap thereon.
FIG. 21 is an enlarged cross-sectional view of the completed drive end of the roller assembly of FIGS. 13-16.
FIG. 22 is an enlarged cross-sectional, exploded view of the non-drive end of the roller assembly of FIGS. 13-16.
FIG. 23 is an enlarged cross-sectional, partially assembled view of the non-drive end of the roller assembly of FIGS. 13-16 prior to installation of the endcap.
FIG. 24 is an enlarged cross-sectional view of the completed non-drive end of the roller assembly of FIGS. 13-16.

Elements #7 and #8 (prior art) are at the assembly's left end (the pulley-end) where the pulley features a third trough (64) and third ring (66) as seen in FIGS. 19 and 20. The third ring and third trough are positioned between the installed pulley's geared section (47*c*) and the roller's second raised ring (61*b*). Element #9 (prior art) is the combination of the pulley's geared section (47*c*), as seen in FIGS. 18 and 19, and the geared spinning belt (not shown) which serve to shred most wayward threads that manage to elude elements #1 through #8.

The following elements are all new and provided by the present invention.

Elements #10 and 11, is a "pulley ring" (67) as seen in FIG. 19. The pulley ring comprises of a fourth trough (68) and small raised ring (69). The ring fits underneath the pulley's geared end (47*c*) and extends well into the pulley's endcap (28*b*) where they serve to trap any wayward threads that might manage to evade elements #1-9 and accumulate around the axle, and potentially jam the third bearing. Elements #10 and #11 thereby serve to virtually seal the assembly's third bearing (30*c*).

Element #12 is at the assembly's opposite/right end, where the roller's second ring (61*a*) is specially shaped to overhang the assembly's right-side endcap (28*a*) as seen in FIG. 22. This overhanging element #12 serves to harmlessly direct those wayward threads that manage to evade elements #1-5 safely into a fifth trough: element #13 (see next).

Elements #13 and #14 comprises of a fifth trough (70) and inward-angled outer ring (72) located atop the preferred embodiment's specially designed right-side endcap (28*a*) as seen in FIG. 23. The fifth trough (70) and inward-angled outer ring (72) are designed to fit underneath and closely with overhanging element #12. Thread guard elements #13 and #14 form what is intended to be the final resting place for wayward threads, which here in the assembly's fifth trough (70) become tightly wound.

Elements #15 and #16 comprises of a sixth trough (74) and small raised ring (76) as seen in FIGS. 23 and 24. The sixth trough (74) and raised ring (76) are incorporated into the design of the first bearing's housing (42*a*), as an extension of the housing. These final thread guard elements (74, 76) may extend beyond the first bearing (30*a*) to reach well inside their endcap (28*a*), thereby being positioned to trap the most elusive of wayward threads that manage to traverse backwardly (rare but possible) over elements #13 and #14 (70, 72), thereby virtually sealing the assembly's first bearing (30*a*).

Thus, as outlined above, the assembly's first and third bearings (30*a*, 30*c*) are virtually sealed by the comprehensive thread guard system of the present embodiment. As seen in FIGS. 19-21, the assembly's second bearing (30*b*) is already completely isolated/sealed inside its housing (42*b*) inside the roller (38) and behind the installed pulley (45).

It will be understood that the invention's three bearings may vary in size. It will be further understood that certain variations in the arrangements of the invention's components may utilize a fourth, fifth or additional bearings. It will be further understood that the present embodiment's geared pulley may be of alternate pulley types, including flat or v-shaped pulleys.

It is further intended that any other embodiments of the invention that result from any changes in application or method of use or operation, method of manufacture, shape, size, or material which are not specified within the detailed written description or illustrations contained herein yet are considered apparent or obvious to one skilled in the art are within the scope of the invention. It is therefore to be recognized that these and various other alterations, modifications, and/or additions may be introduced into the constructions and arrangements of parts described above without departing from the spirit or ambit of the present invention as defined by the appended claims.

What is claimed is:

1. A roller brush assembly for a vacuum nozzle, said roller brush assembly comprising:

a generally tubular roller body having drive and non-drive ends and at least one brush feature on an outer surface thereof;

an elongate axle member disposed annularly within said roller body;

a drive pulley mounted to said drive end of said roller body; and a plurality of bearings supporting said roller body for rotation about said axle, said plurality of bearings comprising:

a first bearing mounted proximate said drive end of said roller body;

a second bearing mounted proximate said non-drive end of said roller body; and a third bearing mounted within said drive pulley at a location distal of said first bearing.

2. The roller brush assembly of claim 1, wherein said third bearing is located substantially adjacent said first bearing at said drive end of said roller body.

3. The roller brush assembly of claim 1 further comprising:

first and second bearing housings having said first and second bearings mounted therein, each said bearing housing comprising:

an interior receptacle that maintains said bearing therein in transverse alignment with said axle; and an exterior surface that engages said roller body so as to maintain said bearing therein in predetermined longitudinal position along said axle.

4. The roller brush assembly of claim 3, wherein said exterior surfaces of said bearing housings comprise:

at least one stop portion that engages a cooperating stop portion on said tubular roller body so as to limit insertion of said bearing housings of said first and second bearings to predetermined locations in said drive and non-drive ends of said roller body.

5. The roller brush assembly of claim 4, wherein said at least one stop portion on said exterior surfaces of said bearing housings comprises:

an external shoulder that cooperates with an internal shoulder of said tubular roller body to limit insertion of said bearing housing to a predetermined position within said roller body.

6. The roller brush assembly of claim 4, wherein said drive pulley comprises:

an interior receptacle that maintains said third bearing therein in transverse alignment with said axle; and an exterior surface that engages said roller body so as to maintain said third bearing in a predetermined longitudinal position on said axle.

7. The roller brush assembly of claim 6, wherein said exterior surface of said pulley comprises:

at least one stop portion that engages a cooperating stop portion on said tubular roller body so as to limit insertion of said pulley and said third bearing to a predetermined location in said drive end of said roller body.

8. The roller brush assembly of claim 7, wherein and at least one stop portion on said exterior surface of said pulley comprises:

an external shoulder on said pulley that cooperates with a shoulder on said tubular roller body to limit insertion of said pulley and said third bearing to a predetermined position within said roller body.

9. The roller brush assembly of claim 7, wherein said predetermined location of said pulley and third bearing is substantially adjacent said predetermined location of said first bearing and bearing housing in said drive end of said roller body.

10. The roller brush assembly of claim 7, wherein said exterior surface of said pulley further comprises:

means for establishing rotational drive engagement between said pulley and said roller body.

11. The roller brush assembly of claim 10, wherein said means for establishing rotational drive engagement between said pulley and said roller body comprises:

a plurality of ribs on said pulley that are received in cooperating slots in said tubular roller body.

12. The roller brush assembly of claim 10, wherein said pulley further comprises:

a toothed drive pulley for engaging a toothed drive belt.

13. The roller brush assembly of claim 7, wherein said elongate axle further comprises:

a raised shoulder proximate said drive end of said roller body that reacts against an inner race of said third bearing so as to maintain said third bearing in said pulley in said predetermined location in said drive end of said roller body.

14. The roller brush assembly of claim 6, wherein said drive pulley is molded over said third bearing so as to precisely locate said third bearing therein.

15. The roller brush assembly of claim 3, wherein said first and second bearing housings are molded over said first and second bearings so as to precisely locate said first and second bearings therein.

16. The roller brush assembly of claim 1, further comprising:

first and second thread guards located proximate said drive and non-drive ends of said roller body.

17. The roller brush assembly of claim 16, wherein said thread guards each comprise:

first and second longitudinally-spaced annular ridges; and a stepped annular trough intermediate said first and second ridges, comprising a first, relatively deeper trough and a second, relatively shallower trough located distal of said first trough.

18. The roller brush assembly of claim 17, wherein each of said thread guards further comprises:

a third trough formed on a proximal side of said spaced annular ridges.

19. The roller brush assembly of claim 1, further comprising:

first and second end cap members mounted to ends of said elongate axle for attachment of said roller brush assembly to a fixed structure of said vacuum nozzle.

20. A vacuum nozzle, comprising:

a nozzle housing; and a roller brush assembly mounted to said nozzle housing, said roller brush assembly comprising:

a generally tubular roller body having drive and non-drive ends and at least one brush feature on an outer surface thereof;

an elongate axle member disposed annularly within said roller body;

a drive pulley mounted to said drive end of said roller body; and a plurality of bearings supporting said roller body for rotation about said axle, said plurality of bearings comprising:

a first bearing mounted proximate said drive end of said roller body;

a second bearing mounted proximate said non-drive end of said roller body; and a third bearing mounted within said drive pulley at a location distal of said first bearing.

21. A roller brush assembly for a vacuum nozzle, said roller brush assembly comprising:

a generally tubular roller body having drive and non-drive ends and at least one brush feature on an outer surface thereof;

an elongate axle member disposed annularly within said roller body;

a drive pulley mounted to said drive end of said roller body;

a plurality of bearings supporting said roller body for rotation about said axle, said plurality of bearings comprising:

a first bearing mounted proximate said drive end of said roller body;

a second bearing mounted proximate said non-drive end of said roller body; and a third bearing mounted within said drive pulley at a location distal of said first bearing; and first and second bearing housings having said first and second bearings mounted therein, each said bearing housing comprising:

an interior receptacle that maintains said bearing therein in transverse alignment with said axle; and an exterior surface that engages said roller body so as to maintain said bearing therein in predetermined longitudinal position along said axle.

22. The roller brush assembly of claim 21, wherein said exterior surfaces of said bearing housings comprise:

at least one stop portion that engages a cooperating stop portion on said tubular roller body so as to limit insertion of said bearing housings of said first and second bearings to predetermined locations in said drive and non-drive ends of said roller body.

23. The roller brush assembly of claim 22, wherein said at least one stop portion on said exterior surfaces of said bearing housings comprises:

an external shoulder that cooperates with an internal shoulder of said tubular roller body to limit insertion of said bearing housing to a predetermined position within said roller body.

24. The roller brush assembly of claim 22, wherein said drive pulley comprises:

an interior receptacle that maintains said third bearing therein in transverse alignment with said axle; and an exterior surface that engages said roller body so as to maintain said third bearing in a predetermined longitudinal position on said axle.

25. The roller brush assembly of claim 24, wherein said exterior surface of said pulley comprises:

at least one stop portion that engages a cooperating stop portion on said tubular roller body so as to limit insertion of said pulley and said third bearing to a predetermined location in said drive end of said roller body.

26. The roller brush assembly of claim 25, wherein and at least one stop portion on said exterior surface of said pulley comprises:

an external shoulder on said pulley that cooperates with a shoulder on said tubular roller body to limit insertion of said pulley and said third bearing to a predetermined position within said roller body.

27. The roller brush assembly of claim 25, wherein said predetermined location of said pulley and third bearing is substantially adjacent said predetermined location of said first bearing and bearing housing in said drive end of said roller body.

28. The roller brush assembly of claim 25, wherein said elongate axle further comprises:

a raised shoulder proximate said drive end of said roller body that reacts against an inner race of said third bearing so as to maintain said third bearing in said pulley in said predetermined location in said drive end of said roller body.

29. The roller brush assembly of claim 25, wherein said drive pulley is molded over said third bearing so as to precisely locate said third bearing therein.

30. The roller brush assembly of claim 21, wherein said first and second bearing housings are molded over said first and second bearings so as to precisely locate said first and second bearings therein.

31. A roller brush assembly for a vacuum nozzle, said roller brush assembly comprising:

a generally tubular roller body having drive and non-drive ends and at least one brush feature on an outer surface thereof;

an elongate axle member disposed annularly within said roller body;

a drive pulley mounted to said drive end of said roller body;

a plurality of bearings supporting said roller body for rotation about said axle, said plurality of bearings comprising:

a first bearing mounted proximate said drive end of said roller body;

a second bearing mounted proximate said non-drive end of said roller body; and a third bearing mounted within said drive pulley at a location distal of said first bearing; and first and second thread guards located proximate said drive and non-drive ends of said roller body, said thread guards each comprising:

first and second longitudinally-spaced annular ridges; and a stepped annular trough intermediate said first and second ridges, comprising a first, relatively deeper trough and a second, relatively shallower trough located distal of said first trough.

32. The roller brush assembly of claim 31, wherein each of said thread guards further comprises:

a third trough formed on a proximal side of said spaced annular ridges.

* * * * *